US006280914B1

(12) United States Patent
Keech et al.

(10) Patent No.: US 6,280,914 B1
(45) Date of Patent: Aug. 28, 2001

(54) PHOTOGRAPHIC ELEMENT WITH REFERENCE CALIBRATION DATA

(75) Inventors: John T. Keech, Penfield; Donald O. Bigelow, Webster; Mark E. Shafer, Fairport; John P. Spence, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/635,496

(22) Filed: Aug. 9, 2000

(51) Int. Cl.[7] ..... G03C 1/00
(52) U.S. Cl. ..... 430/496; 430/403
(58) Field of Search ..... 430/496

(56) References Cited

U.S. PATENT DOCUMENTS

| | | | | |
|---|---|---|---|---|
| 3,718,074 | | 2/1973 | Davis | 396/315 |
| 4,211,558 | | 7/1980 | Oguchi et al. | 430/359 |
| 4,260,245 | | 4/1981 | Hujer | 355/40 |
| 4,365,882 | | 12/1982 | Disbrow | 354/106 |
| 4,464,045 | | 8/1984 | Findeis et al. | 355/38 |
| 4,577,961 | | 3/1986 | Terashita | 355/77 |
| 4,634,850 | | 1/1987 | Pierce et al. | 235/487 |
| 4,786,792 | | 11/1988 | Pierce et al. | 235/456 |
| 4,874,936 | | 10/1989 | Chandler et al. | 235/494 |
| 4,881,095 | | 11/1989 | Shidara | 354/298 |
| 4,884,102 | | 11/1989 | Terashita | 355/77 |
| 4,939,354 | | 7/1990 | Priddy et al. | 235/456 |
| 5,075,716 | | 12/1991 | Jehan et al. | 355/1 |
| 5,189,521 | | 2/1993 | Ohtsubo et al. | 358/296 |
| 5,198,907 | | 3/1993 | Walker et al. | 358/296 |
| 5,267,030 | | 11/1993 | Giorgianni et al. | 358/527 |
| 5,403,140 | * | 4/1995 | Carmichael et al. | 414/280 |
| 5,452,055 | | 9/1995 | Smart | 355/68 |
| 5,519,510 | | 5/1996 | Edgar | 358/471 |
| 5,565,678 | * | 10/1996 | Manian | 250/252.1 |
| 5,591,956 | | 1/1997 | Longacre, Jr. et al. | 235/494 |
| 5,649,260 | | 7/1997 | Wheeler et al. | 396/569 |
| 5,667,944 | | 9/1997 | Reem et al. | 430/359 |
| 5,698,382 | | 12/1997 | Nakahanada et al. | 430/418 |
| 5,736,996 | | 4/1998 | Takada et al. | 347/19 |
| 5,758,223 | | 5/1998 | Kobayashi et al. | 396/604 |
| 5,767,983 | | 6/1998 | Terashita | 358/302 |
| 5,832,328 | | 11/1998 | Ueda | 396/572 |
| 5,960,125 | * | 9/1999 | Michael et al. | 382/294 |
| 5,988,896 | | 11/1999 | Edgar | 396/604 |

FOREIGN PATENT DOCUMENTS

| | | |
|---|---|---|
| 0762201A1 | 3/1997 | (EP) . |
| 0926550A1 | 6/1999 | (EP) . |
| 11-316448 | 11/1999 | (JP) . |

OTHER PUBLICATIONS

U.S. Ser. No. 09/635,389 filed Aug. 9, 2000 by Klees et al.
U.S. Ser. No. 09/635,257 filed Aug. 9, 2000 by Keech et al.
U.S. Ser. No. 09/635,178 filed Aug. 9, 2000 by Cahill et al.
U.S. Ser. No. 09/635,179 filed Aug. 9, 2000 by Keech et al.
U.S. Ser. No. 09/636,058 filed Aug. 9, 2000 by Keech et al.
U.S. Ser. No. 09/635,600 filed Aug. 9, 2000 by Keech et al.
U.S. Provisional Ser. No. 60/211,058 filed Jun. 3, 2000 by Levy et al.
U.S. Provisional Ser. No. 60/211,446 filed Jun. 3, 2000 by Irving et al.
U.S. Provisional Ser. No. 60/211,065 filed Jun. 3, 2000 by Irving et al.
U.S. Provisional Ser. No. 60/211,079 filed Jun. 3, 2000 by Irving et al.

* cited by examiner

*Primary Examiner*—Hoa Van Le
(74) *Attorney, Agent, or Firm*—Thomas H. Close

(57) ABSTRACT

A method of recording a reference calibration target on an APS format photographic element having a reserved area for use by photofinishing apparatus, and a perforation located relative to the reserved area, includes the steps of: generating a reference calibration target having a width no greater than 30.2 mm and a height no greater than 16.7 mm; locating the reserved area of the photographic element relative to the perforation; and recording the reference calibration target within the reserved area.

20 Claims, 2 Drawing Sheets

PHOTOGRAPHIC ELEMENT WITH REFERENCE CALIBRATION DATA

FIELD OF THE INVENTION

The present invention relates to photography, and more particularly to a photographic element having reference calibration data.

BACKGROUND OF THE INVENTION

The use of reference calibration patches exposed on a roll of film to enable better exposure control during optical printing is known in the art. See for example U.S. Pat. No. 5,767,983 issued Jun. 16, 1998 to Terashita entitled Color Copying Apparatus for Determining Exposure Amount from Image Data of an Original Image and a Reference Image. The use of reference calibration patches has also been shown to be useful in determining correction values for scanned film data used in digital printing. See for example U.S. Pat. No. 5,667,944 issued Sept. 16, 1997 to Reem et al. entitled Digital Process Sensitivity Correction; and U.S. Pat. No. 5,649,260 issued Jul. 15, 1997 to Wheeler et al. entitled Automated Photofinishing Apparatus.

The film format known as the Advanced Photo System (APS) as designated in the System Specifications for the Advanced Photo System, referred to as the APS Redbook, reserves specific areas on an APS format film strip for use by photofinishing apparatus. These areas can be used for exposing reference calibration patches and other data used in the photofinishing process. Referring to FIG. 4, an APS format photographic element 10 with a geometry as specified in FIGS. 200-1, 200-2, 210-1, 400 and 600 of the APS Redbook is shown. The photographic element includes a first area 12 reserved for use in photofinishing apparatus, a first imaging frame $\mathbf{14}_1$, a last imaging frame $\mathbf{14}_1$, and a second area 16 reserved for use in photofinishing apparatus. Anticipation perforations $\mathbf{20}_1$–$\mathbf{20}_n$ and metering perforations $\mathbf{22}_1$–$\mathbf{22}_n$ are provided for each imaging frame on the photographic element 10. One additional end of roll perforation 23 is provided in a position corresponding to an anticipation perforation. For film strips intended for use in one-time use cameras, an additional end of roll perforation (not shown) is provided in a position corresponding to a metering perforation after the end of roll perforation 23.

The reserved areas 12 and 16 are wider (in the direction of the length of the photographic element 10) than exposed image areas (not shown) and printed or projected image areas (also not shown) that are located within frames $\mathbf{14}_1$–$\mathbf{14}_n$. Dimensions of these areas are noted in Table 1.

TABLE 1

| Frame | Width (mm) | Height (mm) |
|---|---|---|
| Reserved area 12 | 37.7 | 16.7 |
| Reserved area 16 | 32.45 | 16.7 |
| Exposed image area of Frames 14 | 30.2 | 16.7 |
| Printed or projected image area of Frames 14 | 27.4 | 15.6 |

Some problems are encountered when utilizing reference calibration data applied to the reserved areas 12 and/or 16 on APS format photographic elements. One problem occurs when scanning the extra width in the reserved areas 12 and/or 16 using conventional scanning devices developed for scanning APS imaging frames 14. These devices are designed to scan images of size equal to or smaller than the exposed image area within the frames 14. Extra scanning hardware and software is required to scan the full width of the reserved areas 12 and 16. Also, additional memory may also be required to store the extra pixel information from the scanned reserved areas if the entire areas are scanned. Another problem occurs in locating the calibration data so that existing scanners can accurately and readily retrieve the data. A further problem exists with some existing scanners in that they are physically unable to access the second reserved area 16. A still further problem exists in that variations in placement of the calibration data during recording or the location of the photographic element during scanning can result in the failure to read portions of the data.

There is a need therefore for an improved method of recording calibration data on an APS format photographic element that avoids the problems noted above.

SUMMARY OF THE INVENTION

The need is met according to the present invention by providing a method of recording a reference calibration target on an APS format photographic element having a reserved area for use by photofinishing apparatus, and a perforation located relative to the reserved area, that includes the steps of: generating a reference calibration target having a width no greater than 30.2 mm and a height no greater than 16.7 mm; locating the reserved area of the photographic element relative to the perforation; and recording the reference calibration target within the reserved area.

In a preferred embodiment of the invention, the reference calibration target is recorded in the first reserved area.

ADVANTAGES

The present invention has the advantage that the reference calibration target placed on an APS format photographic element can be read by conventional film scanners used to scan image frames on APS format photographic elements in photofinishing operations. It has the further advantage that all of the data derived by scanning the target in a standard photofinishing apparatus can be stored in existing memory designed to hold scanned image data.

DETAILED DESCRIPTION OF THE INVENTION

Figure 1:
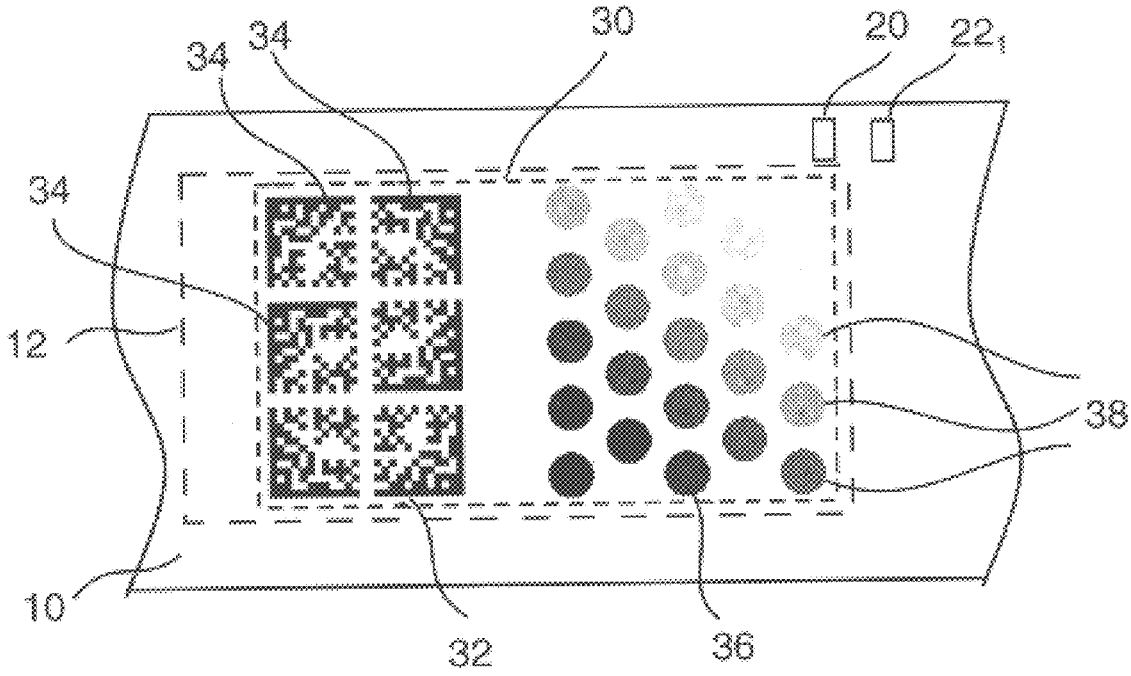
FIG. 1 is a diagram showing the first reserved area on an APS format photographic element and a region for recording reference calibration data according to a preferred embodiment of the present invention.

Referring to FIG. 1, a portion of an APS format photographic element 10 according to the present invention is shown. The photographic element 10 includes at least a base with a photosensitive layer that is sensitive to light to produce a developable latent image. The photosensitive layer may contain conventional silver halide chemistry, or other photosensitive materials such as thermal or pressure developable chemistries. It can have a transparent base, a reflective base, or a base with a magnetically sensitive coating. The photographic element 10 can be processed through standard chemical processes, including but not limited to Kodak Processes C-41 and its variants, ECN-2, VNF-1, ECP-2 and its variants, D-96, D-97, E-4, E-6, K-14, R-3, and RA-2SM, or RA-4; Fuji Processes CN-16 and its variants, CR-6, CP-43FA, CP-47L, CP-48S, RP-305, RA-4RT; Agfa MSC 100/101/200 Film and Paper Processes, Agfacolor Processes 70, 71, 72 and 94, Agfachrome Processes 44NP and 63; and Konica Processes CNK-4, CPK-2–22, DP, and CRK-2, and Konica ECOJET HQA-N, HQA-F, and HQA-P Processes. The photographic element 10 can be processed using alternate processes such as apparently dry processes that may retain some or all of the developed silver or silver halide in the element or that may include lamination and an appropriate amount of water added to swell the photographic element. Depending upon the design of the photographic element 10, the photographic element can also be processed using dry processes that may include thermal or high pressure treatment. The processing may also include a combination of apparently dry, dry, and traditional wet processes. Examples of suitable alternate and dry processes include the processes disclosed in: U.S. Ser. No. 60/211,058 filed Jun. 3, 2000 by Levy et al.; Ser. No. 60/211,446 filed Jun. 3, 2000 by Irving et al.; Ser. No. 60/211,065 filed Jun. 3, 2000 by Irving et al.; Ser. No. 60/211,079 filed Jun. 3, 2000 by Irving et al.; EP Patent No. 0762201A1 published Mar. 12, 1997, by Ishikawa et al., entitled Method of Forming Images; EP Patent No. 0926550A1, published Dec. 12, 1998, by Iwai, et al., entitled Image Information Recording Method; U.S. Pat. No. 5,832,328 issued Nov. 3, 1998 to Ueda, entitled Aittomatic Processing Machinefor a Silver Halide Photographic Light-sensitive Material; U.S. Pat. No. 5,758,223 issued May 26, 1998 to Kobayashi, et al., entitled Automatic Processing Machine for Silver Halide Photographic Light-sensitive Material; U.S. Pat. No. 5,698,382 issued Dec. 16, 1997 to Nakahanada, et al., entitled Processing Method for Silver Halide Photographic LighIt-senisitive Material; U.S. Pat. No. 5,519,510 issued May 21, 1996 to Edgar, entitled Electronic Film Development; and U.S. Pat. No. 5,988,896 issued Nov. 23, 1999 to Edgar, entitled Method and Apparatus for Electronic Film Development.

A reference calibration target 30 which preferably includes an array 36 of reference calibration patches 38 and an array 32 of two-dimensional bar code symbols 34 as disclosed in copending application U.S. Ser. No. 09/635,600, entitled METHOD AND PHOTOGRAPHIC ELEMENT FOR CALIBRATING DIGITAL IMAGES is recorded as a developable latent image onto the photographic element 10 within a first area 12 reserved for use by photofinishing apparatus. According to the present invention, the reference calibration target 30 has a width no greater than 30.2 mm and a height no greater than 16.7 mm, which is the nominal size of an APS exposed image area as noted in Table 1, whereby a conventional scanner employed to scan APS images is able to scan the reference calibration target without physical modification of the hardware or memory of the scanner. All that is required to access and use the information in the reference calibration target is a modification of the software in the scanner to permit scanning the frame.

Figure 2:
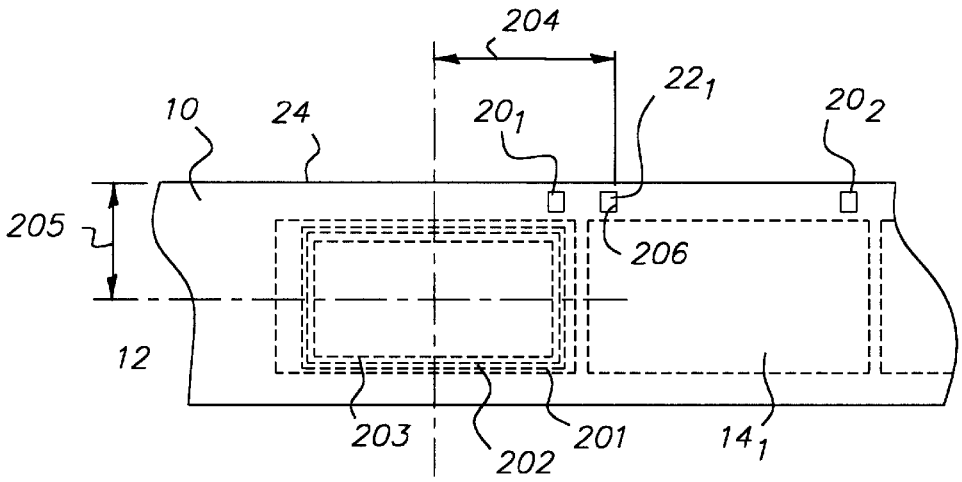
FIG. 2 is a diagram showing the first reserved area on an APS format photographic element and the region for recording reference calibration data according to the present invention.

Referring to FIG. 2, a portion of the photographic element 10 according to the present invention is shown. Within the first reserved area 12, a first zone 201 with a width of 30.2 mm and a height of 16.7 mm is centered at a distance 204 19.75±2.05 mm from the trailing edge 206 of the metering perforation $\mathbf{22}_1$ and a distance 205 11.98±0.5 mm from the edge 24 of the photographic element 10 closest to the perforation $\mathbf{22}_1$. A second zone 202 with a width of 27.4 mm and a height of 15.6 mm is also centered at the distance 204 from the trailing edge 206 of the metering perforation $\mathbf{22}_1$ and the distance 205 from the edge 24. A third zone 203 with a width of 23.4 mm and a height of 12.6 mm is also centered at the distance 204 from the trailing edge 206 of the metering perforation $\mathbf{22}_1$ and the distance 205 from the edge 24. APS scanners in the photofinishing industry meter film placement location by detecting perforations and edges. The common specified center position of the zones 201, 202, and 203 relative to the trailing edge 206 of the metering perforation $\mathbf{22}_1$ and edge 24 places the zones in the same relative position to the first imaging frame $\mathbf{14}_1$ as occurs between each pair of imaging frames, thereby requiring minimal changes to scanner software. By restricting the reference calibration target 30 to lie within the first zone 201, which is the same size as the APS exposed area of frames 14 indicated in Table 1, scanners designed to scan an area the size of an APS exposed image area may be employed. Preferably, the reference calibration target 30 is confined to lie within the second zone 202, which is the same size as the APS printed or projected area of frames 14 indicated in Table 1, so that scanners designed to scan an area the size of the APS printed or projected area may be employed. More preferably, the reference calibration target 30 is confined to lie within the third zone 203, so that variations in placement of the reference calibration target during recording or location of the film during scanning are accommodated, thereby guaranteeing that data in the reference calibration target 30 is not lost.

Figure 3:
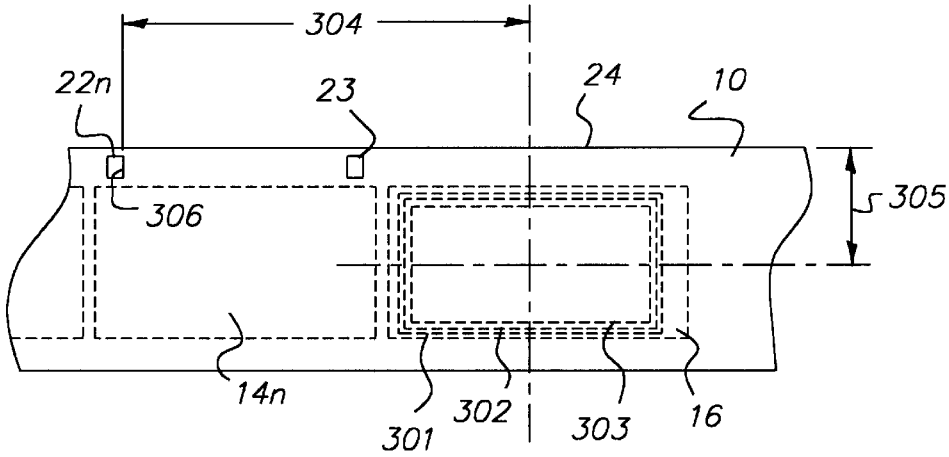
FIG. 3 is a diagram showing the second reserved area on an APS format photographic element and the region for recording reference calibration data according to the present invention.
Figure 4:
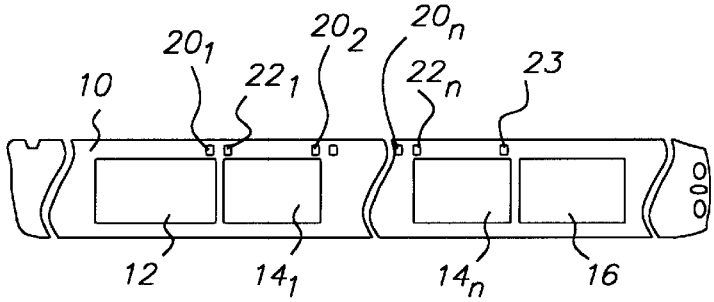
FIG. 4 is a diagram showing an APS format photographic element according to the prior art.

Referring to FIG. 3, a portion of the photographic element 10 according to the present invention is shown. Within the second reserved area 16, a first zone 301 with a width of 30.2 mm and a height of 16.7 mm is centered at a distance 304 43.65±2.2 mm from the trailing edge 306 of the metering perforation $\mathbf{22}_n$ and a distance 305 11.98±0.5 mm from the edge 24 of the photographic element 10 closest to the perforation $\mathbf{22}_n$. A second zone 302 with a width of 27.4 mm and a height of 15.6 mm is also centered at the distance 304 from the trailing edge 306 of the metering perforation 22, and the distance 305 from the edge 24. A third zone 303 with a width of 23.4 mm and a height of 12.6 mm is also centered at the distance 304 from the trailing edge 306 of the metering perforation $\mathbf{22}_n$ and the distance 305 from the edge 24. The common specified center position of the zones 301, 302, and 303 relative to the trailing edge 306 of the metering perforation $\mathbf{22}_n$ and edge 24 places the zones in the same relative position to the last imaging frame $\mathbf{14}_n$ as occurs between each pair of imaging frames, thereby requiring minimal changes to scanner software. By restricting the reference calibration target 30 to lie within the first zone 301, which is the same size as the APS exposed area of frames 14 indicated in Table 1, scanners designed to scan an area the size of an APS exposed image area may be employed. Preferably, the reference calibration target 30 is confined to lie within the second zone 302, which is the same size as the APS printed or projected area of frames 14 indicated in Table 1, so that scanners designed to scan an area the size of the APS printed or projected area may be employed. More preferably, the reference calibration target 30 is confined to lie within the third zone 303, so that variations in placement of the reference calibration target during recording or location of the film during scanning are accommodated, thereby guaranteeing that data in the reference calibration target 30 is not lost.

In some scanners using the thrust drive feature of an APS cartridge containing an APS format film strip, the second reserved area 16 is not accessible. When using these scanners, the APS format film is returned to its cartridge after processing and before scanning, and is not fully removed from its cartridge during scanning, thereby constraining access to the second reserved area during scanning. Therefore, it is preferred to use the first reserved area according to the present invention.

The invention has been described in detail with particular reference to certain preferred embodiments thereof, but it will be understood that variations and modifications can be effected within the spirit and scope of the invention.

PARTS LIST

| | |
|---|---|
| 10 | APS format photographic element |
| 12 | first reserved area |
| 14 | imaging frame |
| 16 | second reserved area |
| 20 | anticipation perforation |
| 22 | metering perforation |
| 23 | end of roll perforation |
| 24 | edge of photographic element |
| 30 | reference calibration target |
| 32 | array of two-dimensional bar code symbols |
| 34 | two-dimensional bar code symbols |
| 36 | array of reference calibration patches |
| 38 | reference calibration patches |
| 201 | first zone |
| 202 | second zone |
| 203 | third zone |
| 204 | distance |
| 205 | distance |
| 206 | trailing egde |
| 301 | first zone |
| 302 | second zone |
| 303 | third zone |
| 304 | distance |
| 305 | distance |
| 306 | trailing edge |

What is claimed is:

1. An APS format photographic element, comprising:

a) a base;

b) a photosensitive layer on the base;

c) a perforation in the base;

d) a reserved area located on the photographic element with respect to the perforation; and e) a reference calibration target having a width no greater than 30.2 mm and a height no greater than 16.7 mm, recorded as a latent image in the photosensitive layer within the reserved area.

2. The APS format photographic element claimed in claim 1, wherein the perforation is a first metering perforation and the reference calibration target has a center located in the reserved area 19.75±2.05 mm from the trailing edge of the first metering perforation and 11.98±0.5 mm from the edge of the photographic element closest to the first metering perforation.

3. The APS format photographic element claimed in claim 2, wherein the reference calibration target is no greater than 27.4 mm wide and no greater than 15.6 mm high.

4. The APS format photographic element claimed in claim 3, wherein the reference calibration target is no greater than 23.4 mm wide and no greater than 12.6 mm high.

5. The APS fonnat photographic element claimed in claim 1, wherein the perforation is a last metering perforation and the reference calibration target has a center located in the reserved area 43.65±2.2 mm from the trailing edge of the last metering perforation and 11.98±0.5 mm from the edge of the photographic element closest to the last metering perforation.

6. The APS format photographic element claimed in claim 5, wherein the reference calibration target is no greater than 27.4 mm wide and no greater than 15.6 mm high.

7. The APS format photographic element claimed in claim 6, wherein the reference calibration target is no greater than 23.4 mm wide and no greater than 12.6 mm high.

8. The APS format photographic element claimed in claim 1, wherein the photosensitive layer contains conventional silver halide chemistry.

9. The APS format photographic element claimed in claim 1, wherein the photosensitive layer contains thermal developable chemistry.

10. The APS format photographic clement claimed in claim 1, wherein the photosensitive layer contains pressure developable chemistry.

11. The APS format photographic element claimed in claim 1, wherein the reference calibration target includes an array of reference calibration patches and an array of bar code symbols.

12. The APS format photographic element claimed in claim 1, wherein the photographic element is a film strip.

13. A method of recording a reference calibration target on an APS format photographic element having a reserved area for use by photofinishing apparatus, and a perforation located relative to the reserved area, comprising the steps of:

a) generating a reference calibration target having a width no greater than 30.2 mm and a height no greater than 16.7 mm;

b) locating the reserved area of the photographic element relative to the perforation; and c) recording the reference calibration target within the reserved area.

14. The method claimed in claim 13, wherein the perforation is a first metering perforation and further comprising the step of: locating the center of the reference calibration target in a reserved area 19.75±2.05 mm from the trailing edge of the first metering perforation and 11.98±0.5 mm from the edge of the photographic element closest to the first metering perforation.

15. The method claimed in claim 14, wherein the reference calibration target is no greater than 27.4 mm wide and no greater than 15.6 mm high.

16. The method claimed in claim 15, wherein the reference calibration target is no greater than 23.4 mm wide and no greater than 12.6 mm high.

17. The method claimed in claim 13, wherein the perforation is a last metering perforation and further comprising the step of: locating the center of the reference calibration target in a reserved area 43.65±2.2 mm from the trailing edge of the last metering perforation and 11.98±0.5 mm from the edge of the photographic element closest to the last metering perforation.

18. The method claimed in claim 17, wherein the reference calibration target is no greater than 27.4 mm wide and no greater than 15.6 mm high.

19. The method claimed in claim 18, wherein the reference calibration target is no greater than 23.4 mm wide and no greater than 12.6 mm high.

20. The method claimed in claim 3, wherein the reference calibration target includes an array of reference calibration patches and an array of bar code symbols.

* * * * *